US006173255B1

(12) United States Patent
Wilson et al.

(10) Patent No.: US 6,173,255 B1
(45) Date of Patent: Jan. 9, 2001

(54) SYNCHRONIZED OVERLAP ADD VOICE PROCESSING USING WINDOWS AND ONE BIT CORRELATORS

(75) Inventors: Dennis L. Wilson, Palo Alto; James L. Wayman, Pebble Beach, both of CA (US)

(73) Assignee: Lockheed Martin Corporation, Bethesda, MD (US)

( * ) Notice: Under 35 U.S.C. 154(b), the term of this patent shall be extended for 0 days.

(21) Appl. No.: 09/135,937

(22) Filed: Aug. 18, 1998

(51) Int. Cl.[7] ..... G01L 21/00
(52) U.S. Cl. ..... 704/216; 704/219
(58) Field of Search ..... 704/226–228, 704/219, 207, 209, 216–218

(56) References Cited

U.S. PATENT DOCUMENTS 4,064,481 * 12/1977 Silverman ..... 367/190
4,710,959 * 12/1987 Feldman et al. ..... 704/207
5,353,374 * 10/1994 Wilson et al. ..... 704/226
6,018,704 * 1/2000 Kohli et al. ..... 702/149

* cited by examiner

*Primary Examiner*—David D. Knepper
(74) *Attorney, Agent, or Firm*—Kenneth W. Float

(57) ABSTRACT

Apparatus and methods for compressing an audio signal. An analog to digital converter is used to digitize the audio signal. A linear predictor processes the digitized audio signal to attenuate coherent noise and produce a residual output signal that is representative of the audio signal. An improved synchronized overlap add processor employs a one bit correlator and a smoothly-shaped window compresses the digitized audio signal. The synchronized-overlap-add processing may be used with voice or audio processing systems to change the time scale of the voice (audio) signal without changing the pitch of the processed signal. The synchronized-overlap-add processing may also be used to reduce noise in the processed signal. The present synchronized-overlap-add processing technique makes the computations required very quick, improving the utility of the processing.

19 Claims, 3 Drawing Sheets

SYNCHRONIZED OVERLAP ADD VOICE PROCESSING USING WINDOWS AND ONE BIT CORRELATORS

BACKGROUND

The present invention relates generally to audio (voice) processing, and more particularly, to a synchronized-overlap-add technique using one bit correlation and windowing that may be used in audio processing and audio compression systems.

Changing the time scale of a voice signal can be done at the cost of changing the pitch by simply speeding up playback of the signal. For a digitized signal, speed-up involves increasing the sample rate on play-back. As the sample rate is increased, the pitch frequency of the voice signals increases. At the extreme, the pitch is high enough to have a "chipmunk" quality.

A technique for maintaining pitch while changing the time scale is a synchronized overlap-add technique. The voice signal is segmented into blocks. Overlapping the next block with a previous block and adding the new block to the old block reduces the time scale of the voice signal, speeding up the signal for a constant sample rate.

This simple approach has problems because the voice signal does not match with a random overlap. Hence, the signal is "synchronized" with the old block before adding it the new signal. The new block is shifted in time until the signal has a high correlation with the existing block. With this displacement, the new signal can be overlapped and added to the old signal block and still maintain the signal through the transition without possible harmful destructive interference. The two signals are added coherently, instead of randomly.

One of the effects of synchronized overlap add processing is suppression of random noise. Noise that is not correlated with the voice signal is added incoherently and is suppressed. The larger the overlap, the more times the voice signal will be added and the more the noise is suppressed.

The time scale may be expanded as well a contracted. Overlapped blocks of the voice signal may be shifted in time to be farther apart as well as closer together. Synchronization of the voice signal is necessary on expansion of the signal as well as on the contraction of the signal. If a signal is first contracted, then expanded, the voice signal at its original time scale can be reconstructed. The reconstructed voice signal will have its noise suppressed, depending on the number of times that the voice signal has been added to a synchronous version of itself in the process of contraction and re-expansion.

A very simple voice compression technique uses the synchronized overlap-add technique to contract the signal, compressing the signal. This is disclosed in U.S. Pat. No. 5,353,374 entitled "Low Bit Rate Voice Transmission for Use in a Noisy Environment", issued Oct. 4, 1994 and assigned to the assignee of the present invention. In accordance with the teachings of this patent, the compressed signal is transmitted, then re-expanded. Compression due to synchronized overlap-add processing of more than four to one has been demonstrated. With further compression using information coding techniques, compression of another factor of four is possible. The result can be a compressed voice signal with data rates less that 4 kilobits per second. With silence suppression, the average data rate can be less than 2 kilobits per second.

In the past, synchronized overlap-add processing has been accomplished by segmenting the voice signal into blocks, then performing the correlation of the blocks directly. The process requires that one block be shifted with respect to the other and the two signals multiplied point by point and the products added together. This is disclosed in an article by J. L. Wayman and D. L. Wilson entitled "Some improvements on the synchronized-overlapped method of time-domain modification for real-time speech compression and noise filtering", IEEE Journal on Acoust. Speech and Signal Proc., Vol. 36, 1988 pp. 139–140, and in U.S. Pat. No. 5,353,374 cited above. The number of required multiply-adds is the number of points that overlap times the number of different shifts in time that are to be tested. This number can be as many as 100 times the number of samples in a block.

A computerized search was performed to investigate prior art patents relating to the present invention. A number of patents were uncovered and are discussed below.

U.S. Pat. No. 5,630,013 entitled "Method of and apparatus for performing timescale modification of speech signals", issued to Suzuki et al, and dated May 13, 1997 outlines a technique for time-scale modification that is part of the substance of my patent cited above. This patent discloses fulll correlation and time delayed windowing.

U.S. Pat. No. 5,175,769 entitled "Method for time-scale modification of signals", issued to Hejna, et al. and dated Dec. 29, 1992 discloses the same square windows and full correlation discussed in Suzuki's patent above and my original patent.

U.S. Pat. No. 5,479,564 entitled "Method and apparatus for manipulating-pitch and/or duration of a signal", issued to Vogten et al, and dated Dec. 26, 1995 discloses finding the peaks of the pitch period and using these times for placing the windows of the overlap add.

U.S. Pat. No. 4,864,620 entitled "Method for performing the time-scale modification of speech information or speech signals", issued to Bialick, and dated Sept. 5, 1989 discloses a scheme similar to that of my patent using square windows or "frames". An "Average Magnitude Difference Function" is used in the correlation process such that no multiplication or division is required. Smooth transitions are achieved by applying a graduated weighting.

U.S. Pat. No. 5,355,363 entitled "Voice transmission method and apparatus in duplex radio system", issued to Takahashi, et al. and dated Oct. 11, 1994 discloses the use of time scale modification to compress a transmitted signal into segments that can be transmitted with gaps during which a receiver can receive the return side signal similarly compressed.

U.S. Pat. No. 4,064,481 entitled "Vibrator and processing systems for vibratory seismic operation", issued to Silverman, and dated Dec. 20, 1977 discloses the use of one bit correlation in processing of a chirped seismic signal.

The present invention relates to one bit correlation to locate matching times in a signal and a synchronized overlap add signal that is constructed. After correlation to find the matching time, the signal is windowed with a smooth window and added to the synchronized overlap add signal. The patents discussed above use windows, typically applied before the synchronization is performed. The windows are typically square windows, although U.S. Pat. No. 4,864,620 discloses the use of some type of smooth windowing.

The only patent that mentions one-bit correlation is U.S. Pat. No. 4,064,481 which relates to an entirely different application, seismic signal processing, and does not teach using one-bit correlation for use in time-scale modification.

It would therefore be desirable to have an improved audio (voice) processing system and method that uses a synchronized-overlap-add technique with one bit correlation and windowing, and that overcome limitations of conventional approaches. Accordingly, it is an objective of the present invention to provide for a audio processing system and method that uses an improved synchronized-overlap-add technique with one bit correlation and windowing.

SUMMARY OF THE INVENTION

To accomplish the above and other objectives, the present invention provides for a voice processing system and method that embodies synchronized-overlap-add processing using one bit correlation and smooth windowing. The present synchronized overlap-add processing technique is much simpler than conventional techniques, and uses a "one bit" correlator with windowed voice signals. The one bit correlator may be implemented with a logic operation that is easy and fast to accomplish.

Synchronized-overlap-add processing techniques may be used with voice processing to change the time scale of the voice signal without changing the pitch of the voice. Synchronized-overlap-add processing may also be used to reduce noise in a voice signal. The present invention implements synchronized-overlap-add processing using one bit correlation and smooth windowing. This approach makes the required computations very quick, improving the utility of the processing.

The present invention provides for improvements to synchronized overlap add processing of voice signals for purposes of time scale modification. The present invention provides for improvements to the systems and methods disclosed in U.S. Pat. No. 5,353,374 entitled "Low Bit Rate Voice Transmission for Use in a Noisy Environment", discussed in the Background section.

The improvements provided by the present invention include one bit correlation and smooth windowing. In U.S. Pat. No. 5,353,374, a square window and full multiplication in the correlation is employed. The voice signal is windowed by selecting the next segment of the voice signal. The segment is placed in the overlapped signal by correlating the new segment with the overlapped signal being constructed.

The present window procedure uses a smoothly shaped window such as a raised cosine window. The smoothly shaped window is placed for the overlapped signal such that window segments abut appropriately for a smooth envelope of the window shapes. The signal is then located by a correlation procedure that uses only one bit, the sign bit of the signal and the overlapped signal that is constructed in the correlation process. This correlation is a simple logic operation that can be performed much more rapidly in a computer or much more simply in hardware.

Once the signal segment is located with respect to the overlapped signal, the signal is windowed and added to the overlapped signal. The addition extends the overlapped signal by an amount that depends on the amount of overlap. The next segment can then be processed.

The inverse procedure extends the time scale of the signal, restoring the original time scale or creating some other time scale, as appropriate to the application.

The improved synchronized overlap add procedure of the present invention may be used in a voice compression scheme as discussed in the patent cited above.

The present invention thus provides for a simple and effective method of implementation of synchronized-overlap-add processing using windows and one-bit correlators. The windows provide a technique for implementation that does not modulate the time compressed or expanded signal. The one-bit correlation provides for very fast and effective time alignment of voice signal blocks. Synchronized-overlap-add processing may be used to change the time scale of a voice signal without changing the pitch.

BRIEF DESCRIPTION OF THE DRAWINGS

The various features and advantages of the present invention may be more readily understood with reference to the following detailed description taken in conjunction with the accompanying drawing, wherein like reference numerals designate like structural elements, and in which.

DETAILED DESCRIPTION

Figure 1:
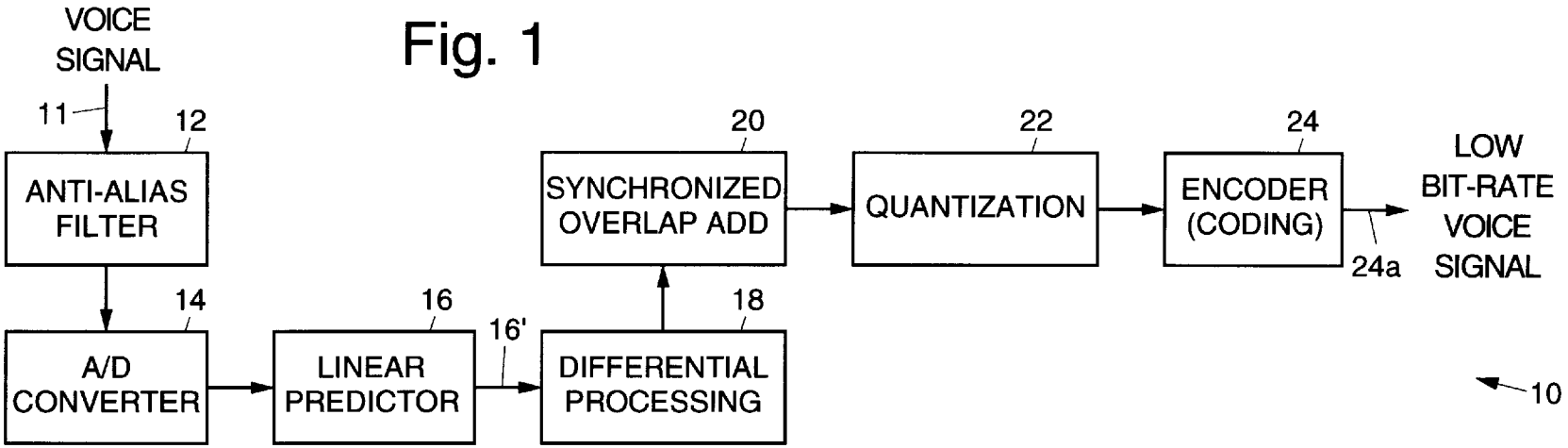
FIG. 1 is a circuit block diagram illustrating a voice compressor in accordance with the principles of the invention
Figure 2:
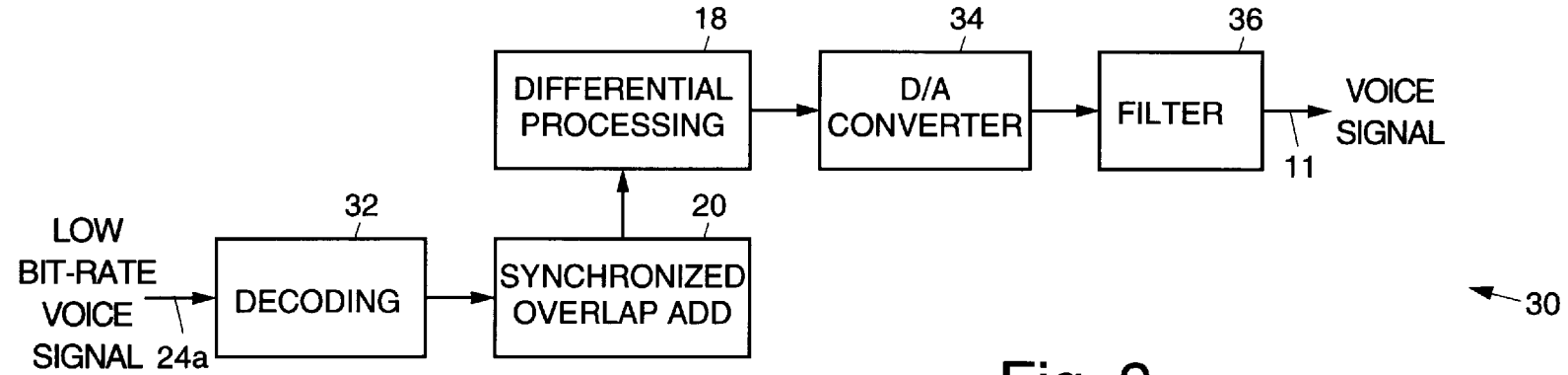
FIG. 2 is a circuit block diagram illustrating a voice decompressor in accordance with the principles of the invention

Referring to the drawing figures, a block diagram of a voice (audio) encoder 10 or voice compressor 10 is shown in FIG. 1, and a corresponding voice (audio) decoder 30 or voice decompressor 30 is shown in FIG. 2. Referring to FIG. 1, a voice signal 11 is filtered by an anti-alias filter 12 and digitized by an analog-o-digital (AID) converter 14 at a convenient sample rate, such as an industry standard rate of 8000 samples per second, using 12 bit conversion, for example. It is to be understood that the present invention is independent of the number of bits in the quantization and is not limited to the exemplary 12 bit conversion. The signal 11 is filtered by the anti-alias filter 12 to prevent aliasing by removing frequencies higher than the Nyquist frequency (such as 4000 Hz, for example, for the above sampling rate). However, the present invention is not limited to any specific filtering frequency or sampling rate. The resulting high quality signal at the output of the AID converter 14 has a bit rate of 96 kbits per second, for example. Again, the present invention is not limited to any specific A/D conversion bit rate. In a telephone application the 12 bits may be reduced to 8 bits by A-law or Mu-law companding, for example, which encodes the voice signal 11 by using a simple nonlinearity.

The converted voice signal 11 is passed through a linear predictor 16 to remove coherent noise. The linear predictor 16 is described in detail in U.S. Pat. No. 5,353,374, the contents of which are incorporated herein by reference in its entirety. As is described in U.S. Pat. No. 5,353,374, the linear predictor 16 comprises a plurality of serially coupled delay elements that produces delayed samples that are weighted and summed. A coefficient adjustment block is used as a predictor of the incoming digitized voice signal sample. An error signal is generated by taking a difference between the incoming sample and the prediction output from the summation. The error is correlated with the digitized voice signal sample at each delay time, and is used to correct the coefficients used in the prediction.

The error signal output is the residual signal after the predicted signal is removed from the incoming signal. The signals that are removed from the input are those that can be predicted. The time constants of the coefficient changes are set to be long with respect to one second. As a result, the voice signal 11 is not predicted, and appears as the residual output signal of the linear predictor 16. However, more slowly varying coherent signals, such as 60 cycle hum, motor noise, and road noise, are predicted and are strongly attenuated in the residual signal output from the predictor 16.

The voice signal 11 is then processed by a differential processor 18 that operates by taking successive differences between samples to generate a continuous signal during reconstruction. This technique eliminates one source of distortion in the voice signal 11.

The voice signal 11 is processed by an improved synchronized overlap and add processor 20 in accordance with the principles of the present invention. The improved synchronized-overlap add processor 20 of the present invention uses one bit correlation and smooth windowing. The synchronized overlap and add processor 20 suppresses white noise while also reducing the effective sample rate by an amount that is adjustable to achieve a desired quality in the reproduced signal. The synchronized overlap and add processor 20 thus time-compresses the voice signal 11. This will be discussed in more detail below. For example, when the signal is compressed by a factor of four, the result is essentially transparent to the voice signal 11, and incoherent noise is noticeably suppressed. At a compression ratio of 8 to 1, the result is nearly transparent. When thee compression is 16 to 1, the reproduced voice signal 11 is intelligible, but has begun to degrade.

The encoding process is completed by coding the voice signal 11 using a quantization circuit 22 and a coding circuit 24. The application of A-law or Mu-law companding by the quantization circuit 22 reduces the signal, from a 12-bit signal to an 8-bit signal, for example. Any of several known techniques for information coding may then be applied by the coding circuit 24. Huffman coding is a well known technique for information coding, and is operable to reduce the signal to an average of two to four bits per sample. Using a Huffman coding technique, and the time compression of the voice signal 11 provided by the synchronized overlap and add processor 20, the resulting bit rate of the encoded voice is 2 kbits to 4 kbits per second.

A second coding technique employs an arithmetic coder to achieve an encoding efficiency that is similar to that of the Huffman coder. A third coding technique is to use a transform coder, or an adaptive transform coder. For the third technique, the signal is transformed using a fast Fourier transform or other transform, that is typically a transform that can be executed using a fast algorithm. The transform coefficients are quantized, establishing the quality of the information coding process. The transform coefficients are then encoded using Huffmnan or arithmetic coding techniques. In general, transform coding produces a 4:1 to 8:1 compression of the voice signal 11. The resulting encoder output 24*a*, when using a transform coder, for example, is one kbits per second to two kbits per second of high quality voice signal 11. A fourth coding technique employs a linear predictive coder such as the LPC10 coder or code excited linear predictive coder, for example.

The decoder 30 for the low bit rate voice signal 11 is shown in FIG. 2, and follows the path of the encoder 10 in reverse. The signal is first processed by a decoder 32 to remove the Huffinan or arithmetic information coding, and then through a reverse compander to remove the nonlinearity of the companding. The signal is then processed by a second synchronized overlap and add expander 20 to recover the original time scale of the signal. Finally the differential processing is removed by an inverse processing step performed by a second differential processor 18. No attempt is made to reverse the linear prediction processing that was applied by the linear predictor 16 of FIG. 1, since this would add coherent noise back into the original signal. The digital signal is then converted to an analog signal by a D/A converter 34, and the analog signal is filtered by a filter 36 to provide a high quality voice signal 11.

Thus, it can be seen that a voice signal encoding system 10 and method 70 (FIG. 7) of the invention employs linear prediction to suppress a coherent noise component of a digitized voice signal 11, differentially encodes the voice signal 11, performs synchronized overlap add processing 20, 70 to time-compress the voice signal 11, and codes 22, 24 the resultant compressed voice signal to further compress the voice signal 11 to a desired low bit-rate. While the circuitry and processing discussed above is substantially similar to the circuitry and processing described in U.S. Pat. No. 5,353,374, the key aspects of the present invention reside in improvements in the synchronized overlap and add processor 20. These improvements will be described with reference to FIGS. 3–7.

Figure 3:
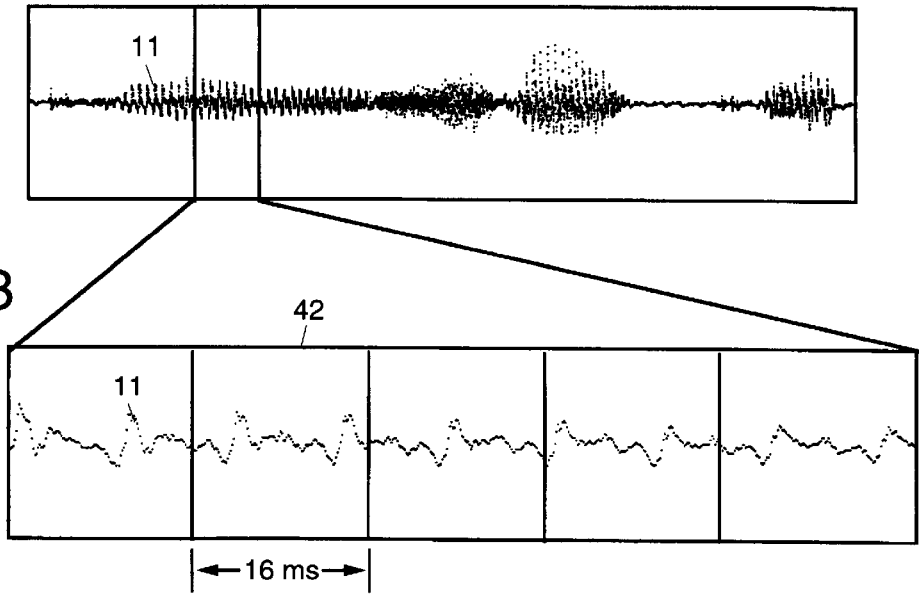
Fig. 3 (PRIOR ART)
FIG. 3 illustrates conventional processing of voice signals blocked to produce 16 millisecond segments.

Prior synchronized overlap-add processing systems and method, and in particular the processing used in U.S. Pat. No. 5,353,374, have processed a simple block 42 of a voice signal 11. A typical sampling rate for voice signals 11 is 8000 samples per second, which is used by phone companies for digital transmission of telephone signals. A typical block 42 of voice signal 11 is 128 samples or 16 milliseconds of data. FIG. 3 shows the process of blocking the voice signal 11 to form 16 millisecond blocks 42.

Figure 4:
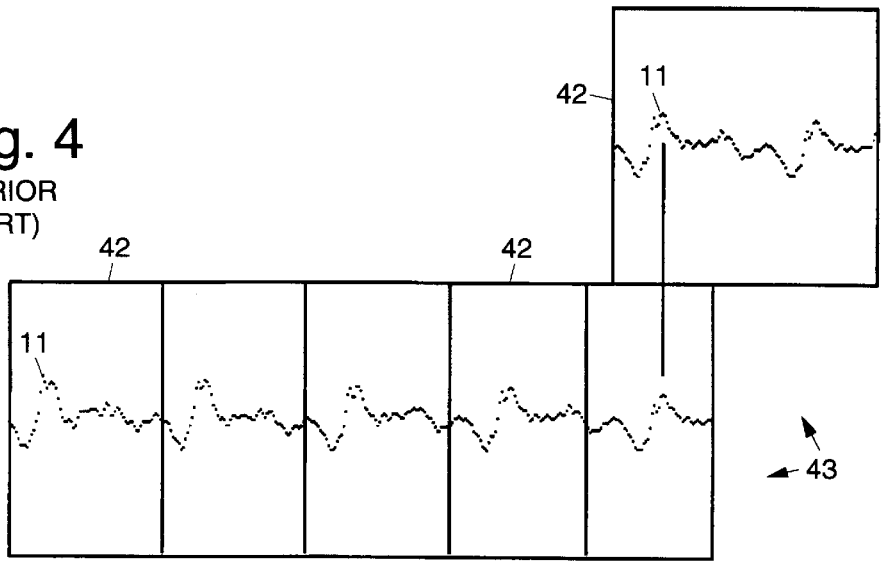
Fig. 4 (PRIOR ART)
FIG. 4 illustrates conventional processing of blocked voice signals.

FIG. 4 illustrates conventional processing of blocked voice signals 11, wherein a new block 42 is overlapped and time aligned before is added to the time-compressed block 42. FIG. 4 shows the blocks 42 of the voice signal 11 are organized to compress the time scale of the voice signal 11 by a factor of two by overlapping the blocks 42 such that one half of a block 42 overlaps a previous block 42. Adjusting the alignment by a small amount synchronizes the new block 42 with the old block 42. The old block 42 is then added to the data stream that is the time-compressed signal.

The blocking is, in effect, a window 43 on the signal. The process of time aligning the voice signal 11 before adding the signal 11 to the data stream causes edges of the blocks 42 to not align very well. In the vicinity of the transitions between blocks 42 this scheme generates transients that can be annoying in the reconstructed voice signal 11.

Figure 5:
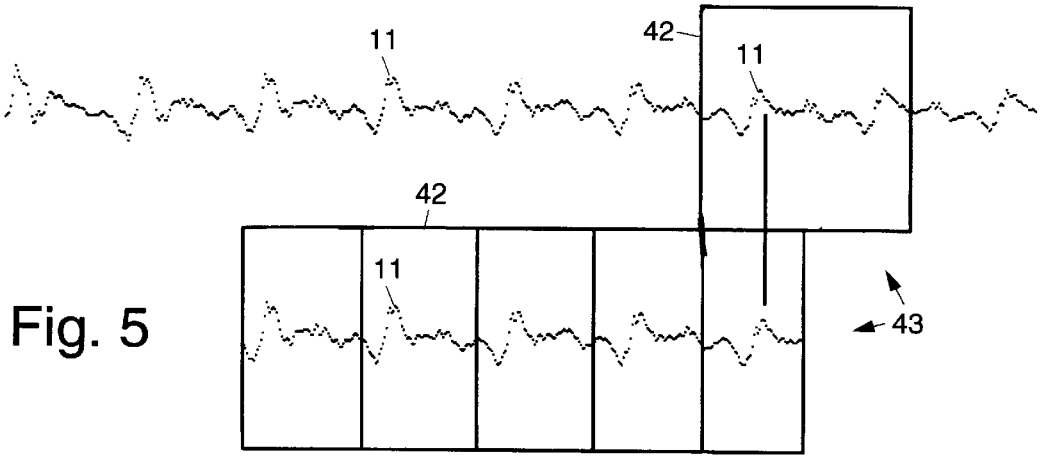
FIG. 5 illustrates a conventional windowing process

One technique for reducing the transient is to window 43 longer blocks 42. FIG. 5 illustrates a conventional windowing process. The window 43 is time-aligned carefully so that the edges of the windows 43 align exactly. The longer block 42 is aligned with the compressed signal 41, then windowed by multiplying the block 42 by the window 42 before adding it to the time-compressed signal. FIG. 5 illustrates that windowing longer blocks removes transients due to mismatching of the boundaries of the block 42 after time adjustment.

Figure 6:
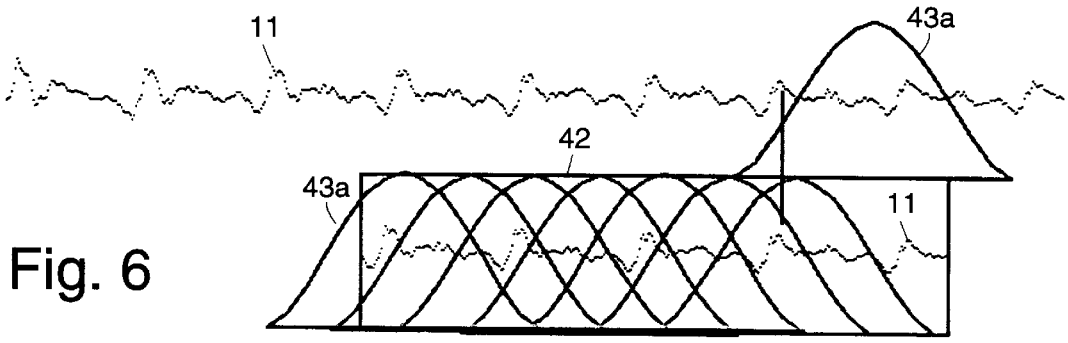
FIG. 6 illustrates the use of smooth windows in accordance with the principles of the present invention to window the blocks of the voice signal.

However, the present inventors have found that in using the windowing technique, the windows 43 need not be square. FIG. 6 illustrates the use of smoothly-shaped windows 43*a* in accordance with the principles of the present invention which is used to window blocks 42 of the voice signal 11. FIG. 6 shows results of windowing when the windows 43*a* are a smoothly shaped, which is one aspect of the present invention. Using the smoothly-shaped windows 43*a*, the transients at the edge of the aligned windows 43*a* are removed, since the windows 43*a* smoothly approach zero at the ends.

The smoothly-shaped window 43*a* is designed to cover the same energy in the signal as the square window 43. This means that the length of the smoothly-shaped window 43*a* is about twice as long as the length of the square window 43, which is about 32 milliseconds, in order that the center area of the smoothly-shaped window 43*a* covers about 16 milliseconds.

The process of alignment requires that the signal 41 that is added to the time-compressed block 42 be correlated over a time interval with the time-compressed block 42 to find the time displacement with the maximum correlation. The correlation process is a point by point multiplication of the signal 41 with the time-compressed block 42 with the results added to form a correlation coefficient. For each possible displacement another correlation value is formed. A low frequency speech waveform may have a frequency as low as 100 Hz for the fundamental frequency. The time displacements tested for maximum correlation should therefore extend over a range of at least 1/100 second or ±5 milliseconds from a nominal center point.

A very much faster correlation process is a one bit correlation 50 (FIG. 7), which is another aspect of the present invention. The one bit correlation 50 is formed by correlating the sign 52 of the signal with the sign 60 of the time-compressed signal. A single processing step forms one bit for each sample that indicates whether the sign of the sample is plus or minus. Using a computer, the bits for each sample may be packed into computer words, 16, 32, or 64 bits in length. The concatenation of only a few words is required to hold the sign of long lengths of signal.

The one bit correlation 50 is equivalent to a simple logic operation on the computer words containing the signal sign bits. An EXCLUSIVE-OR operation produces a "1" when the two signs are different and a "0" when the signs are the same. The EXCLUSIVE-OR of two long signal sign words identify where the signs are the same and where they are different. Counting the number of zeroes in a string is equivalent to forming the correlation of the signals. The shift of the signal that is added to the time-compressed signal is equivalent to a logical right or left shifting of the signal sign word. The correlation 50 may be performed again with the shifted signal.

Figure 7:
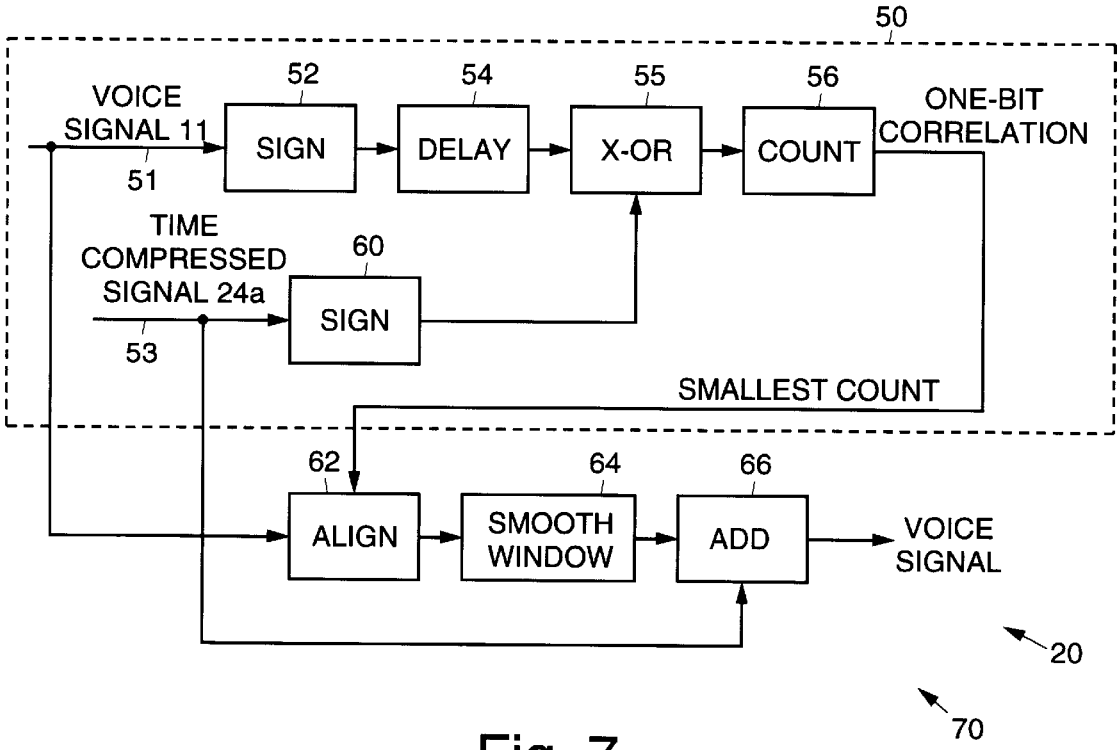
FIG. 7 illustrates a processing architecture for implementing a one bit correlation in accordance with the principles of the present invention.

FIG. 7 illustrates a processing architecture for implementing one bit correlation 50 in accordance with the principles of the present invention. The processing involves simple logical operations. At the delay with the smallest count, the voice signal 11 is windowed and added to the time compressed signal.

The logical operation of the one bit correlation on the extended signal sign words is much faster than the conventionally-used multiplication and addition required to form the signal correlation. Only a few computer words are required, 16 words for the signal sign compared to 256 words for the complete signal block for a 16 bit computer. For a 32 bit computer, only 8 words are required. The one bit correlation is therefore a fast logic operation on a few computer words compared to a much slower multiply and add process on many signal sample values.

For the synchronized-overlap-add processing 20 in accordance with the present invention, the one bit correlation 50 produces results that are as good as a full correlation. The alignment of segments of the voice signal 11 is essentially the same using the two techniques. After the alignment is performed, the signal block 42 is windowed and added to the compressed block.

The architecture of the synchronized-overlap-add processor 20 and method 70 shown in FIG. 7 is as follows. A voice signal 11 is sampled 51. A time compressed voice signal 24*a* is also sampled 53. The sign 52 of the voice signal 11 is determined. The sign 60 of the time compressed voice signal 24*a* is also determined. The sign of 52 the voice signal 11 is delayed 54. A one bit correlation 50 is formed by correlating the sign 52 of the voice signal 11 with the sign 60 of the time compressed voice signal 24*a*. This is done by EXCLUSIVE-ORing 55 (X-OR) the sign 52 of the voice signal 11 with the sign 60 of the time compressed voice signal 24*a* and then counting 56 the number of zeroes in the string. Then the signals 11, 24*a* are time-aligned 62. After the signals 11, 24*a* are time-aligned 62, the signal block is windowed 43*a* using a smoothly-shaped window 43*a* and the windowed signal block is added 66 to the compressed block.

After the voice signal 11 has been time compressed, it may be expanded using the synchronized-overlap-add processor 20 and method 70. Copies of the time compressed signal are correlated with the time expanded signal. When the signals are aligned, the time compressed window is windowed and added to the time expanded window.

The window 43*a* that is shown in FIG. 6 is a "raised cosine" window 43*a*, a portion of a cosine waveform added to a step value to make the minimum be at zero instead of being symmetrical about the axis. The raised cosine window 43*a* has the attribute that two such windows overlapped such that the edge of one window 43*a* extends to the center of the other window 43*a* will add to one. When the signals are windowed and added, the result is that there is no window modulation of the amplitude of the time compressed signal.

Many windows 43*a* will have the attribute of adding to one. All that is required is that the window 43*a* be symmetrical about the center of one half of the window 43*a*. The raised cosine window 43*a* is a convenient window 43*a* to use, since it has useful frequency filtering properties.

In using the present windowed synchronized-overlap-add processor 20 and method 70, it is convenient to select the length of the window 43*a* such that one window 43*a* starts just at the center of a previous window 43*a*. For example, for a simple overlap, the most recent window 43*a* should start at the center of the previous window 43*a*. With this arrangement, the amplitude of the signals are constant in the time compressed signal as discussed above. A signal that is being compressed four to one should have the start of the most recent window 43*a* such that it is at the center of the fourth most recent window 43*a*. Four windows 43*a* are overlapped with this arrangement, so that for every window 43*a* there is a matching window 43*a* such that the sum of the two windows 43*a* adds to one, providing a time compressed signal with no amplitude modulation. Manipulation of the window length within fairly narrow bounds provides an unmodulated time compressed signal for a wide range of values of time compression.

Thus, using the synchronized-overlap-add processor 20 and method 70 of the present invention, the correlation of a signal with the time compressed signal for alignment may be done very effectively using a one bit correlator 50. The one bit correlator 50 correlates the signs 52 of the signal 41 and the time compressed signal 41*a* instead of the signals themselves.

Adjusting the alignment of the signals, windowing the signal, then adding the signal to the time compressed signal extends the time compressed signal by one segment in a way that produces no modulation of the amplitude of the time compressed signal. Processing the time compressed signal using the synchronized-overlap-add processor 20 and method 70 to produce a time expanded signal adjusts the time scale back to the original time scale. Applying time compression or time expansion using one bit correlation and windowing can adjust the time scale of the voice signal 11 over a wide range without changing the pitch of the signal.

Thus, a synchronized-overlap-add technique using one bit correlation and smooth windowing that may be used in audio (voice) processing has been disclosed. It is to be understood that the above-described embodiment is merely illustrative of some of the many specific embodiments that represent applications of the principles of the present invention. Clearly, numerous and other arrangements can be readily devised by those skilled in the art without departing from the scope of the invention.

What is claimed is:

1. A method for processing an audio signal, comprising the steps of:

digitizing the audio signal;

processing the digitized audio signal using a linear predictor to attenuate coherent noise contained in the audio signal to produce a residual output signal that is representative of the audio signal;

processing the residual output signal using a synchronized overlap add processor for compressing the audio signal using one bit correlation and smooth windowing; and further compressing the audio signal using an encoder to provide a compressed digital output signal that corresponds to the audio signal.

2. The method recited in claim 1 wherein the step of further compressing the audio signal is accomplished by a coding method selected from the group including a Huffman coding method, an arithmetic coding method, a transform coding method, and a linear predictive coding method.

3. The method recited in claim 1 further comprising the step of companding the compressed audio signal component.

4. The method recited in claim 1 further comprising the step of processing the residual output signal using a differential processor that delays a sample of the audio signal, and subtracts the delayed sample from a current sample of the audio signal.

5. The method recited in claim 1 wherein the step of processing the residual output signal using a synchronized overlap add processor comprises the step of correlating the sign of the voice signal with the sign of the time compressed voice signal.

6. The method recited in claim 5 wherein the correlating step comprises the step of EXCLUSIVE-ORing the sign of the voice signal with the sign of the time compressed voice signal and counting the number of zeroes in the string.

7. The method recited in claim 5 further comprising the step of time-aligning the signals.

8. The method recited in claim 7 further comprising the steps of windowing the signal block using a smoothly-shaped window and adding the windowed signal block to the compressed block.

9. The method recited in claim 1 further comprising the steps of:

decoding the compressed audio signal to produce a partially expanded digitized audio signal;

decompressing the partially expanded digitized audio signal using a synchronized overlap add processor;

differentially processing the decompressed partially expanded digitized audio signal to delay a sample thereof and add the delayed sample to a current sample of the decompressed digitized audio signal; and converting the decompressed digitized audio signal to an analog audio signal.

10. Apparatus for compressing an audio signal, comprising:

an analog to digital converter for digitizing the audio signal; and a linear predictor for processing the digitized audio signal to attenuate coherent noise and produce a residual output signal that is representative of the audio signal; and a synchronized overlap add processor comprising a one bit correlator and a smoothly-shaped window for compressing the digitized audio signal to provide a compressed audio signal.

11. The apparatus recited in claim 10 further comprising an encoder for further compressing the compressed digitized audio signal to provide a digital output signal that corresponds the voice signal.

12. The apparatus recited in claim 10 wherein the encoder is selected from a group including a Huffman encoder, an arithmetic encoder, a transform encoder, and a linear predictive encoder.

13. The apparatus recited in claim 10 further comprising a differential processor disposed between the linear predictor and the synchronized overlap add processor that delays a sample of the digitized audio signal, and subtracts the delayed sample from a current sample.

14. The apparatus recited in claim 13 further comprising an encoder for further compressing the digitized audio signal by encoding the compressed digitized audio signal to provide a digital output signal that corresponds to the voice signal.

15. The apparatus recited in claim 10 wherein the one bit correlator correlates the sign of the voice signal 11 with the sign 60 of the time compressed voice signal.

16. The apparatus recited in claim 15 wherein the one bit correlator EXCLUSIVE-ORs the sign of the voice signal with the sign of the time compressed voice signal 24*a* and counts the number of zeroes in the string.

17. The apparatus recited in claim 10 further comprising a time-alignment circuit for time-aligning the signals.

18. The apparatus recited in claim 10 wherein an output of the smoothly-shaped window is added to the compressed block to produce the compressed audio signal.

19. The apparatus recited in claim 10 further including an audio expander comprising:

a decoder for decoding the compressed audio signal to produce a partially expanded digitized audio signal;

a synchronized overlap add processor for decompressing the partially expanded digitized audio signal;

a differential processor for delaying a sample of the decompressed digitized audio signal, and for adding the delayed sample to a current sample of the decompressed digitized audio signal; and a digital-to-analog converter for converting the decompressed digitized audio signal to an analog audio signal.

* * * * *